US005338382A

United States Patent [19]

Johnson et al.

[11] Patent Number: 5,338,382

[45] Date of Patent: Aug. 16, 1994

[54] FABRICATION OF PILE WEATHERSTRIPPING HAVING FINS

[75] Inventors: Larry E. Johnson, Victor; Peter Galens, Clifton Springs, both of N.Y.

[73] Assignee: Ultrafab Inc., Farmington, N.Y.

[21] Appl. No.: 927,577

[22] Filed: Aug. 10, 1992

[51] Int. Cl.[5] ..... E06B 7/22; D04H 11/00

[52] U.S. Cl. ..... 156/72; 156/169; 156/173; 156/216; 156/227; 156/428; 156/430; 156/433; 156/438; 156/250; 156/202; 156/211; 49/475.1; 49/489.1

[58] Field of Search ..... 49/475, 475.1, 489.1; 156/72, 73.1, 73.2, 216, 226, 227, 428, 430, 433, 435, 436, 439, 443, 459, 461, 467, 475, 560, 161, 166, 167, 169, 173, 202, 171, 438, 250, 269, 211, 202

[56] References Cited

U.S. PATENT DOCUMENTS

| | | | |
|---|---|---|---|
| 2,214,157 | 8/1940 | Brenn | 156/202 X |
| 2,475,019 | 7/1949 | Faris | 156/435 X |
| 2,504,144 | 4/1950 | Morris | 156/202 X |
| 3,175,256 | 3/1965 | Horton . | |
| 3,527,631 | 9/1970 | Ryburn | 156/202 |
| 3,677,851 | 7/1972 | Kayser | 156/169 |
| 3,745,053 | 7/1973 | Amesbury et al. . | |
| 4,148,953 | 4/1979 | Horton . | |
| 4,214,930 | 7/1980 | Burrows . | |
| 4,302,494 | 11/1981 | Horton . | |
| 4,313,990 | 2/1982 | Franklin et al. | 156/72 |
| 4,458,450 | 7/1984 | Young et al. . | |
| 4,588,463 | 5/1986 | Barber et al. | 156/202 X |
| 4,637,948 | 1/1987 | Evans et al. . | |
| 4,849,270 | 7/1989 | Evans et al. . | |

*Primary Examiner*—Jeff H. Aftergut
*Attorney, Agent, or Firm*—Martin LuKacher

[57] ABSTRACT

Pile weatherstripping having rows of pile sandwiching a fin is fabricated so as to precisely locate the height of the fin with respect to the height of the pile. A travelling endless band receives webs providing the fins on opposite sides thereof with the edge of each web, which defines the height of the fin, precisely positioned on a side of the band and the other edge overhanging the edges of the band. Alignment of the webs on the band is provided either by an aligning fixture or by coining the webs to provide lines of indentations which index the webs at the edges of the band. The yarn which forms the pile is wound around the webs and the band and serves to wrap the overhanging portions of the webs around the band, or a guide may be used to facilitate wrapping of the webs around the band, prior to winding of the yarn. Backing strips are attached, as by ultrasonic welding, along the edges of the band. Then the yarn is slit without cutting into the webs. Hold down wires may be used overlying the webs on the surfaces of the bands and below the yarn. These wires are lifted during slitting. After slitting there is provided a pair of weatherstrips having rows of pile provided by the slit yarn, the height of which is precisely located with respect to the height of the fins there between.

24 Claims, 8 Drawing Sheets

FABRICATION OF PILE WEATHERSTRIPPING HAVING FINS

The present invention relates to the fabrication of pile weatherstripping for providing pile weatherstrips having fins the height of which are precisely located with respect to the height of the pile.

The invention may be used to provide pile weatherstripping having one or more fins, the height of which with respect to the height of the pile may be adjusted to accomodate different specifications for air infiltration through weatherstripping. The invention also enables pile weatherstripping having fins to be produced at high speed with efficient use of materials, such as polypropylene which provides the fins thereof, thereby affording economies of cost in the fabrication process.

Pile weatherstripping is manufactured at high speed and at low cost by winding yarn on an endless travelling band or mandrel utilizing the techniques described in U.S. Pat. Nos. 4,148,953 issued Apr. 10, 1979 to Robert C. Horton and 4,302,494 issued Nov. 24, 1981, also to Robert C. Horton.

As described in the later Patent, the fin may be provided by winding tape helically in overlapping relationship on the band, and then covering the tape with a layer of yarn, and then slitting both the tape and the yarn after they have been bonded to backing strips. In the earlier Horton Patent, the fin material is laid over the band and then the yarn is wrapped about the fin material. Both the fin material and the yarn are slit to provide the finned weatherstrips. Since the yarn is subject to puffing after it is slit, the relative height of the pile and the fin is difficult to maintain with precision. The top of the pile may extend above the top of the fin which can interfere with control of air infiltration (sealing). Since a pair of weatherstrips are made in a single operation, the patented processes fabricate each of the weatherstrips with fins. It is sometimes desirable to produce weatherstripping with fins and weatherstripping without fins. It is a feature of the present invention to provide such flexibility in manufacturing of weatherstripping. The use of overlapping tape material to provide the fins does not enable the amount of fin material used to make the weatherstripping to be reduced as much as is desirable. The use of a single wide tape of weatherstripping material makes material handling more difficult and restricts the amount of material that can be wound on a reel and fed into the weatherstrip making machine.

Accordingly, it is the principal object of the present invention to provide an improved method for making pile weatherstripping, wherein the foregoing difficulties and disadvantageous are substantially eliminated.

It is another object of the present invention to provide an improved method of making pile weatherstripping using thin material which may be prefabricated and need not be cut to size in the process of making the weatherstripping.

It is a still further object of the present invention to provide an improved method of making pile weatherstripping having fins which enables the fins to be positioned with the height thereof in precise relationship to the height of the piles of the weatherstripping.

Briefly described, an improved method of making pile weatherstripping in accordance with the invention is capable of fabricating a pair of weatherstrips each having adjacent rows of pile attached to a backing strip, and with at least one of the weatherstrips having one or more fins between its adjacent rows of pile of height in precisely the desired relationship to the height of the pile. The fin is provided by a web which is fed onto a side of a travelling band. The web is aligned so that one of its longitudinal edges is parallel to and at predetermined distance from one of the longitudinal edges of the band and the other of the longitudinal edges of the web overhangs the band. This alignment may be provided by a guide which forms a channel through which the web is advanced as it is placed upon the side of the band. Alternatively, the web may be formed with a longitudinal indentation, as by coining. The longitudinal indentation is precisely located with respect to the edge of the web which forms the height of the fin. This indentation provides means for indexing the web on the band. Such indexing occurs when the web is wrapped around the longitudinal edge of the band, either with a web guide or upon winding of the yarn around the web and the band. The indentation defines an interior corner of the web which indexes itself on an exterior corner of the edge of the band. The backing strips are then attached to the yarn and the band, as by ultrasonic welding which is described in the above referenced Horton Patents. The yarn is then slit, but without cutting the web. This may be accomplished by inserting hold down wires between the yarn and the web and lifting the wire to separate the yarn from the web during slitting. The slit yarn forms the piles and the web provides the fin which extends above the backing strip to a height which is determined by the height of the prefabricated, independent web. The relative height of the fin may be adjusted by adjusting the guide which aligns the web on the band or by adjusting the position of the coined line with respect to the edge of the web which defines the height of the fin. Also a plurality of fins may be placed on the band in overlying relationship to provide a multiple layer fin structure. The fins can also be interleaved between layers of yarn to provide multi-fin weatherstripping.

The foregoing and other objects features and advantages of the invention, as well as presently preferred embodiments thereof, will become more apparent from a reading of the following description in connection with the accompanying drawings in which.

Figure 17:
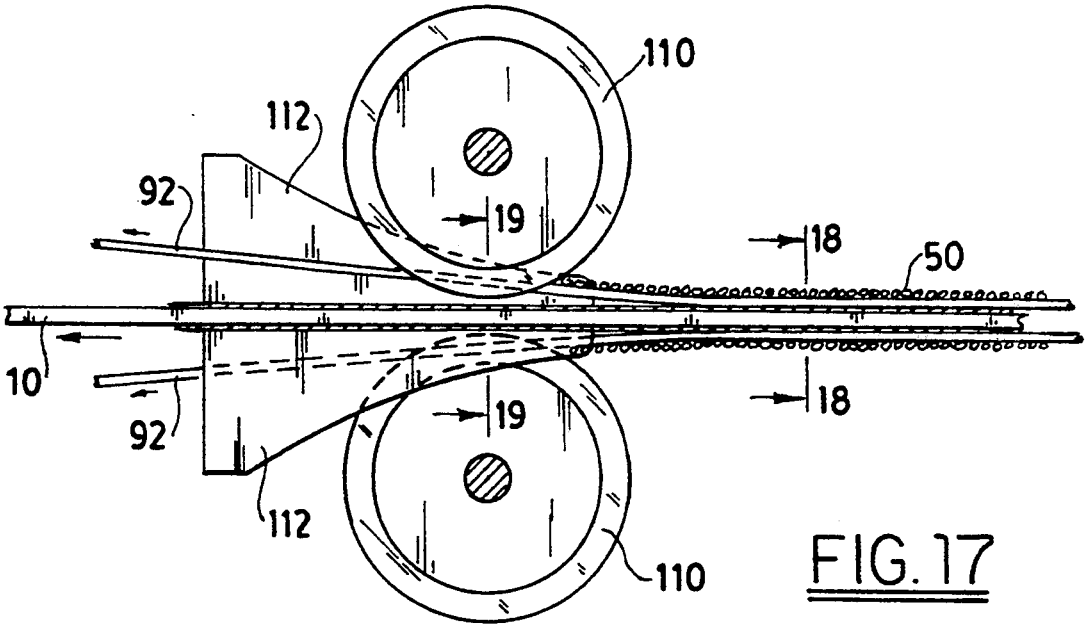
FIG. 17 is an elevational view showing the slitting mechanism.
Figure 18:
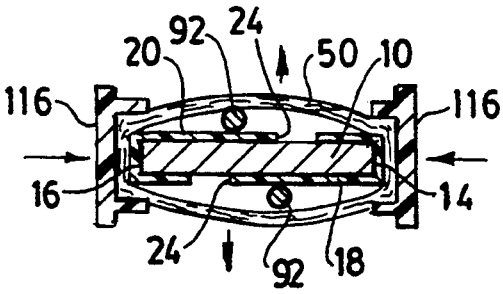
Figure 19:
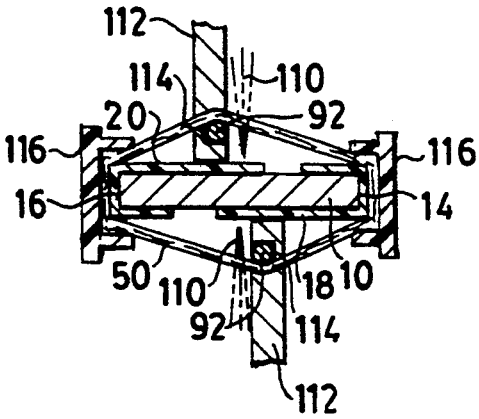

FIGS. 18 and 19 are sectional views taken along the lines 18—18 and 19—19 in FIG. 17, respectively.

Figure 1:
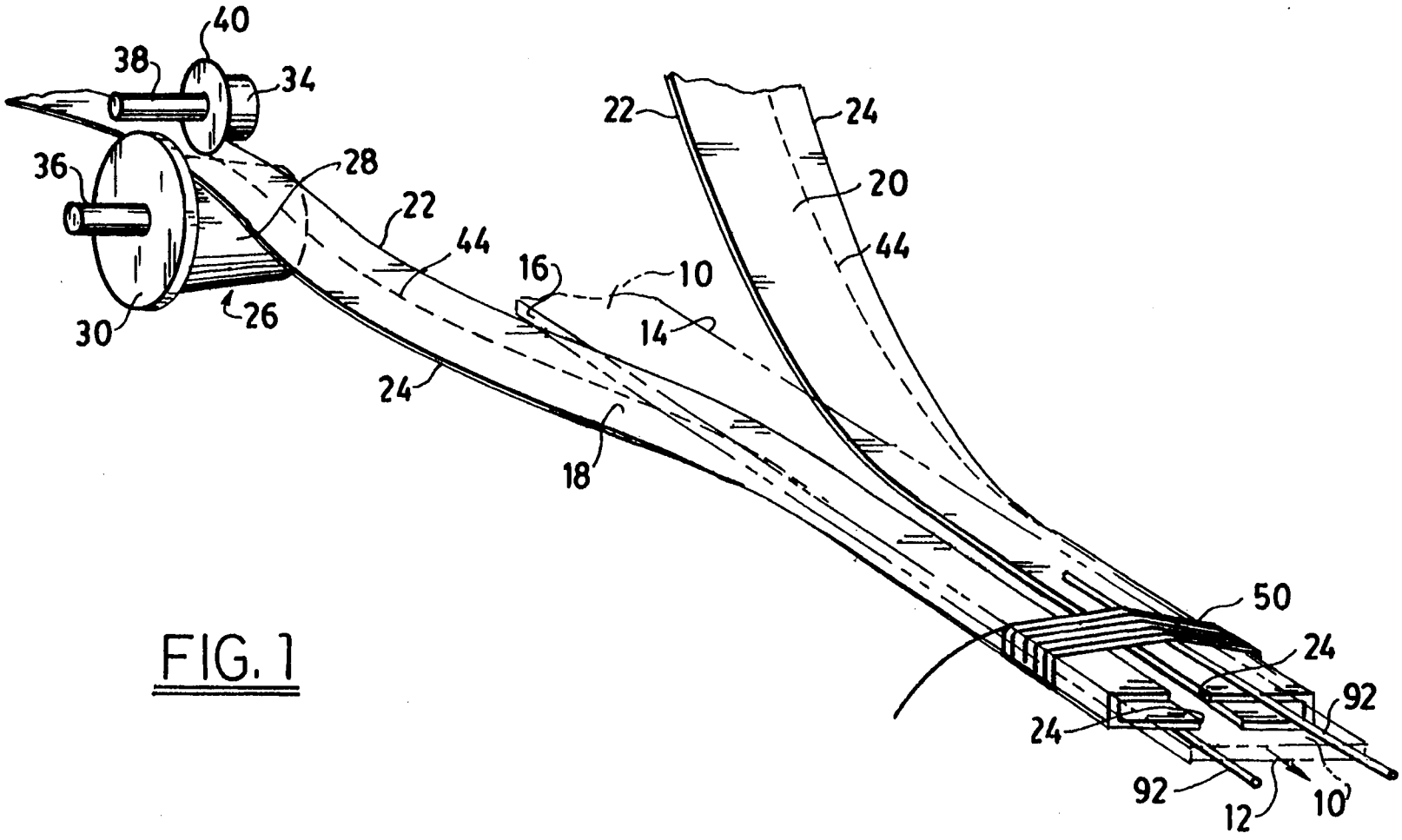
FIG. 1 is a perspective, schematic view showing how the method of the invention may be carried out using coining to locate the height of the fin in making a finned weatherstrip.

Reference should be had to the above identified Horton Patents for the design of a multi-station machine which fabricate pile weatherstrips by winding of yarn around an endless band or mandrel. FIG. 1 shows the endless steel band 10 which travels in the direction indicated by the arrow 12, this band has longitudinal edges 14 and 16. A pair of webs (plastic strips of polypropylene or other plastics or composite materials) are fed onto opposite sides of the band 10 where they are located by guides or rollers (not shown). Two webs, 18 and 20 are indicated. However, a single web may be used if only one of two weatherstrips to be fabricated is to contain a fin. The webs 18 and 20 are prefabricated. They have longitudinal edges 22 and 24 which define the width of the web. One of these edges 22 defines the height of the fin and is aligned so as to be located at a predetermined distance from a longitudinal edge of the band. (14 in the case of the web 20 and 16 in the case of web 18).

Figure 5:
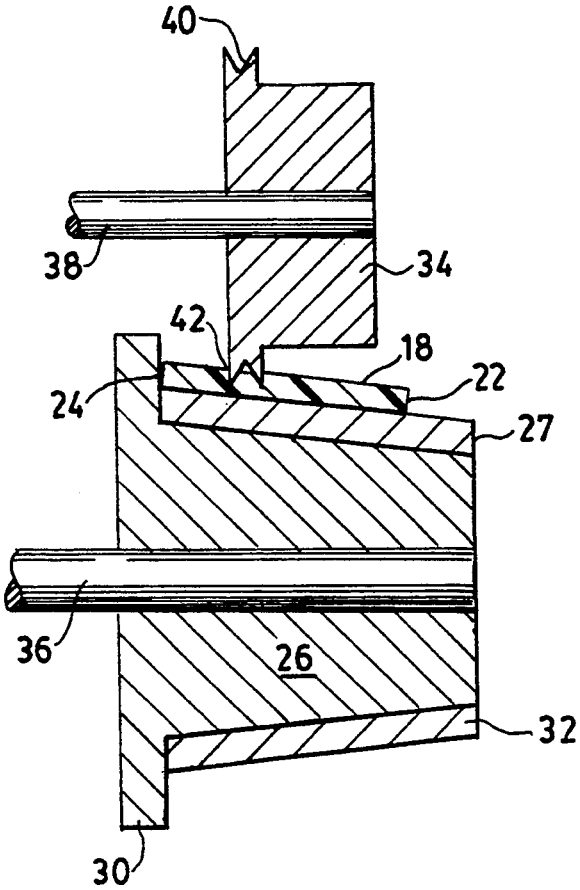
FIG. 5 is a fragmentary sectional view of the coiner wheel and the wheel which drives the web, the view being taken along the line 5—5 in FIG. 4.

This precise alignment is obtained by means of a driven driver wheel 26 having a conically tapered body 28 and a guide flange 30 (see also FIG. 5). The driven tapered wheel 26 preferably has a sleeve 27 of elastomer material which provides a high coefficient of friction and has a high durometer. The web is preferably wrapped around at least 90° of the wheel 26. The edge 24, because of the taper (e.g. of about 5°–15° ) rides up on the wheel and the edge 24 abuts the flange 30 and is indexed at the flange 30.

A driven coin wheel 34, to which pressure is applied in a direction along the line between the axes of the shafts 36 and 38 of the wheels 26 and 34, has an annular coining die with either single or multiple (two or more) points 40. These points indent the web and form an indentation 42 (dual indentations in the case of the coin wheel 34 shown in FIG. 5) along a line or lines 44, precisely positioned with respect to the edge 24 which defines the height of the fin in the fabricated weatherstrip. A similar mechanism containing a tapered wheel and a coin wheel 34*a* and 26*a* may be used to coin the line(s) 44 on the other web 20 (see FIG. 7).

Figure 6:
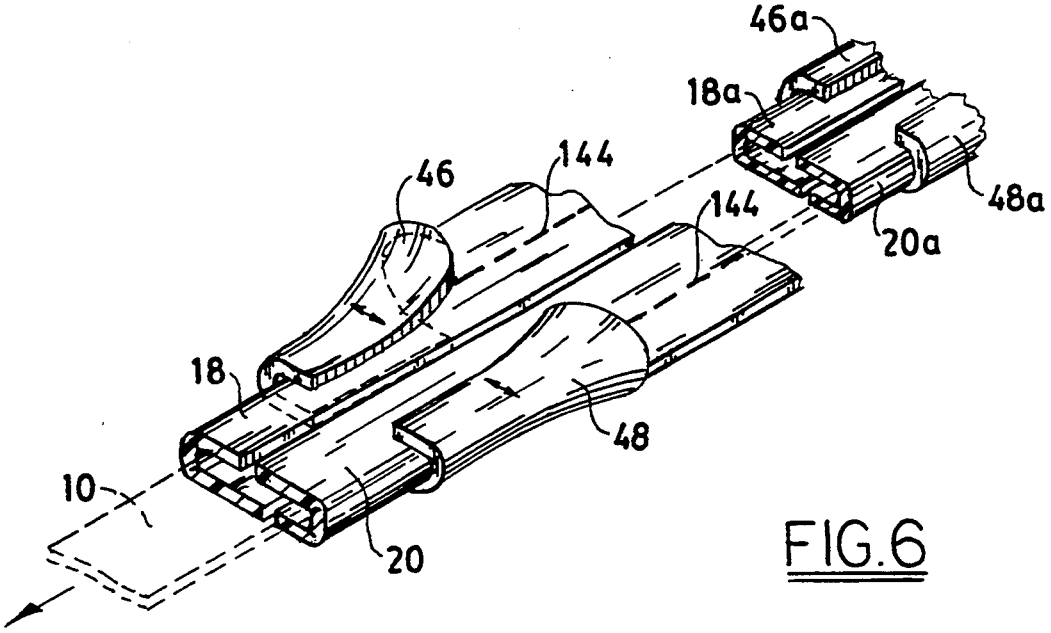
FIG. 6 is a schematic view illustrating the use of guides for wrapping one or more pairs of webs around the band in the process of fabricating the weatherstripping.

The other edge 22 of the webs will overhang the longitudinal edges 14 and 16 of the band 10. These are overhanging edges wrapped around the longitudinal edges of the band 10 by means of wrapping guides 46 and 48 (see FIG. 6) or by the yarn 50 as it is wound tightly around the band 10. The coined web will always seek to bend over the narrowest edge of the band 10 because it forms an internal corner which indexes against the external corner of the longitudinal edge 14 or 16 around which the web is wrapped. The indentation lines (coinings) assure that the webs will be indexed precisely on the band, thereby precisely locating the edges 24 thereof, which define the height of the fins. In the event that dual coinings are used, they may be separated by a distance equal to the thickness of the band so as to provide two corners which index on the adjacent corners of the edges of the band 10. In the event that the height of the fin is to be adjusted, the driven coin wheel is adjustably mounted so as to move axially, thereby changing the position of the line 44 with respect to the edge 24. This enables the height of the web to be adjusted.

Figures 2, 2A:
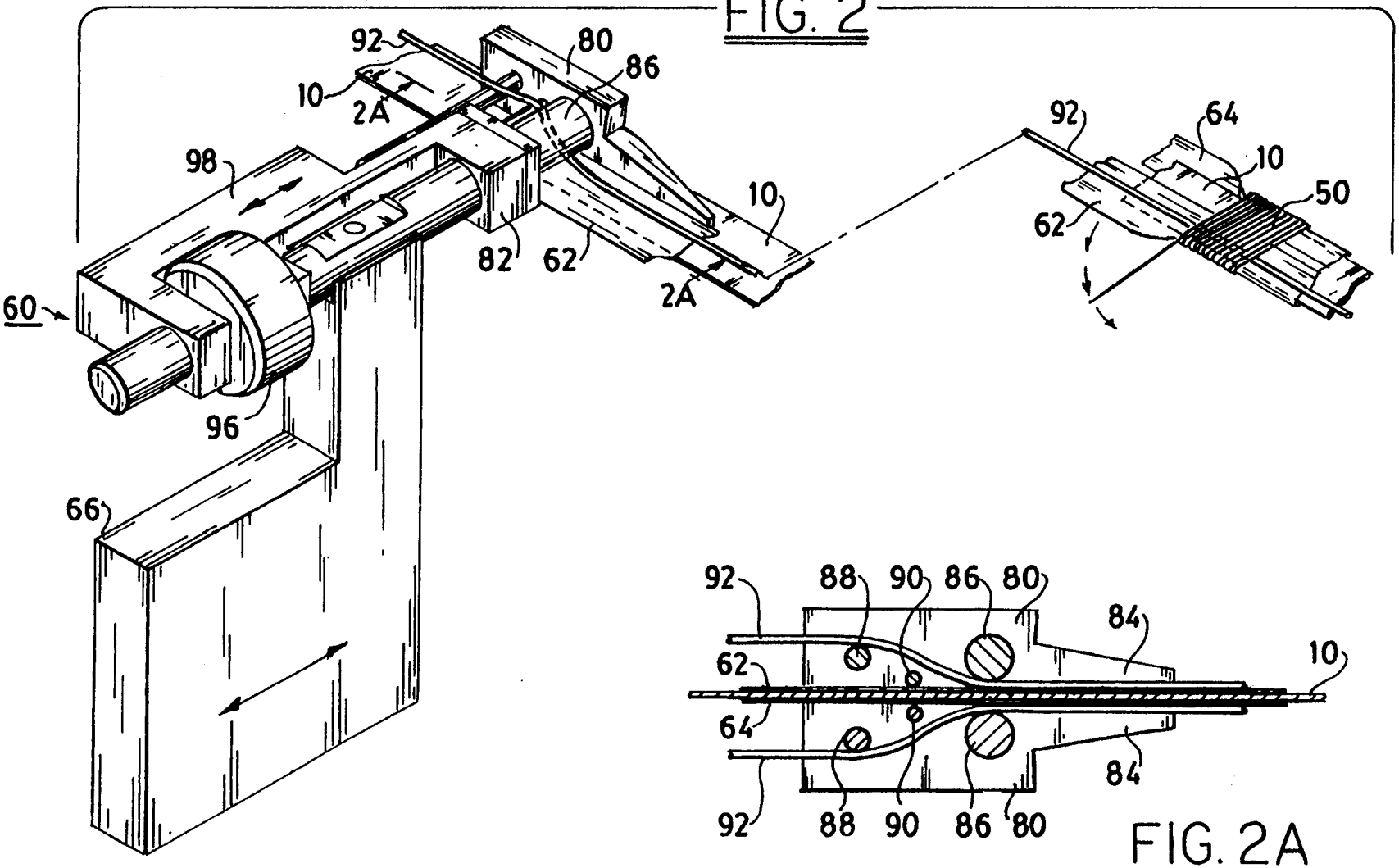
FIG. 2 is a perspective view illustrating a guide structure for locating a web with respect to a band so as to set the height of the fin in a finned weatherstrip.
FIG. 2A is a fragmentary sectional view taken along the line 2A—2A in FIG. 2.

It may be desirable to provide for precise positioning of the fin forming webs without the need for coining, as when the edges of the band 10 are knurled in order to promote attachment by ultrasonic welding of the backing strip to the yarn and the fin material. Then, guide mechanisms 60 are used for guiding each of the webs and aligning them on the sides of the band 10. Only one of these mechanisms 60 is shown in FIG. 2 which guides one web 62. A similar mechanism 60*a* is provided for guiding the other web 64 onto the other side of the band 10 (see FIG. 3). These mechanisms are provided by blocks 66 which are disposed in slides 68 for movement in a direction perpendicular to a direction of travel of the bands, as indicated by the arrows 70. A micrometer adjustment mechanisms 72 adjusts the lateral positions of the mechanisms 60. Slide rollers 74 may be used to capture and guide the mechanisms for the lateral movement in the directions of the arrow 70 on the slides 68.

The mechanisms include jaws 80 and 82 which define a channel through which the webs 62 are guided. These channels are disposed on opposite sides of the band 10. The fixed yaws 80 have noses 84. The moveable jaws 82 are moveable on shafts 86, a portion of which extends between the jaws 80 and 82. Also extending outwardly from the fixed jaws in a lateral direction across the channel between the jaws, are rigid rods 88 and 90 (see also FIG. 2A). The rods 90 guide the webs 62 and 64 under the shafts 86. The shafts 86 have annular grooves and, together with the rods 88, define paths for guide wires 92. These wires are disposed on top of the webs and under the yarn 50 and are used to raise the yarn above the webs so that the yarn can be slit without cutting the web or otherwise interfering with the position of the web on the band. The coining embodiment shown in FIG. 1 similarly makes use of guide wires on the outside of the webs and inside of the yarn. These wires are also indicated by the reference numerals 92.

Figure 3:
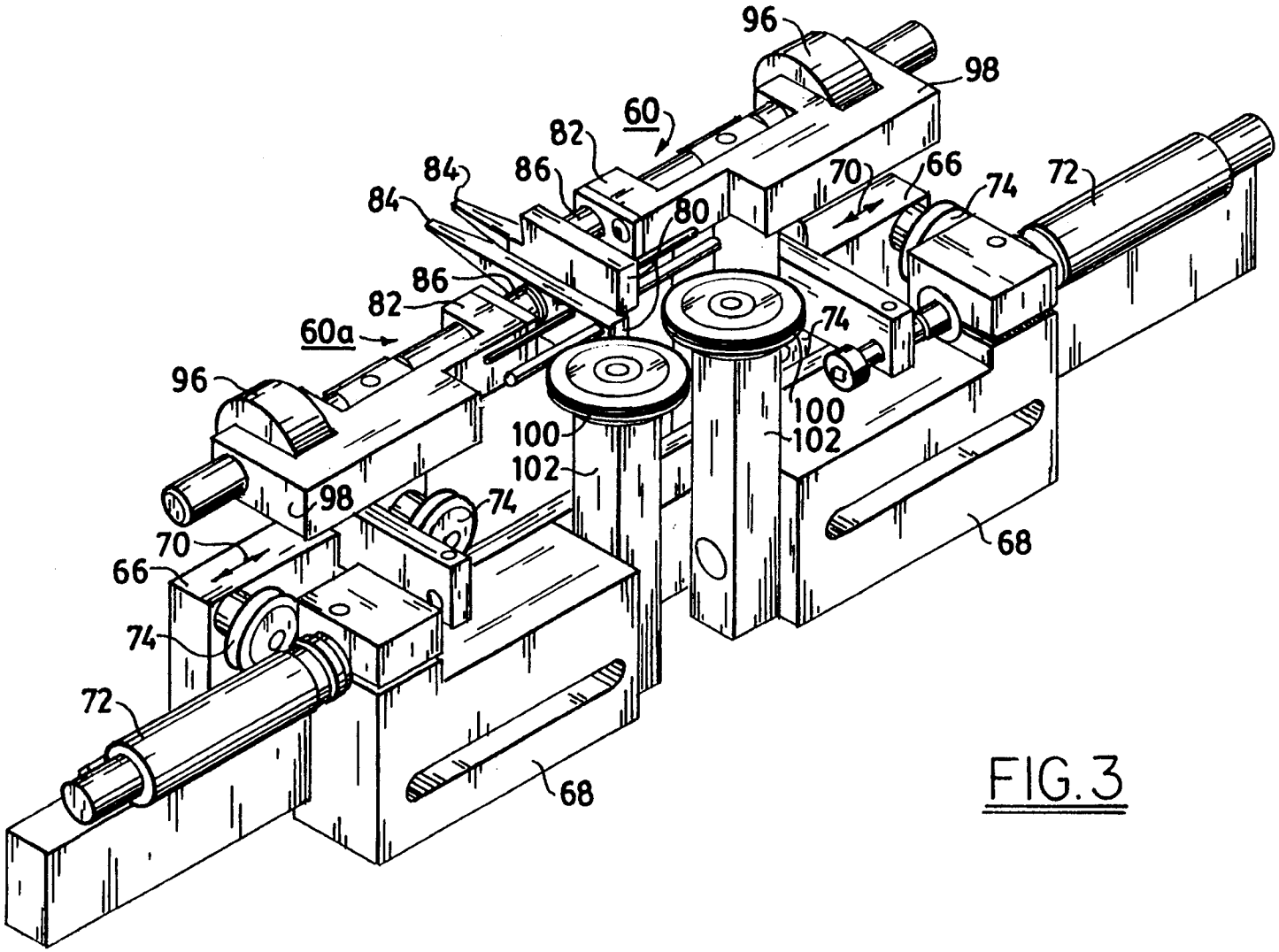
FIG. 3 is a perspective view illustrating the mechanism which is shown in FIG. 2, but for fabricating of a pair of weatherstrips, both of which have fins.

A micrometer adjustment mechanism 96 advances the shaft 86 axially with respect to the jaw 82 and the member 98. Guide wheels 100 on post 102 attached to the slide block 68 edge guide the band 10 so that it moves through the channels provided between the jaws 80 and 82, as shown in FIG. 3.

The slitting mechanism is shown in FIG. 17 and its operation is illustrated in FIGS. 18 and 19. There are slitter wheels 110 which are driven by drive motors and suitable gearing, as discussed in the above referenced Horton Patents. The cutting edges of these wheels are spaced from the band 10 and well above the webs 18 and 20 which provide the fins. Guides 112 extend between the slitter wheels 110. These guides have notches 114 through which the wires 92 pass, causing the wires to raise the yarn 50 to slitting position shown in FIGS. 17 and 19. After the yarn is slit, separate weatherstrips are provided, since the yarn and the webs, prior to slitting, were welded to backing strips 116, thereby attaching them to the yarn and to the webs along the longitudinal edges 14 and 16 of the band 10. The latter step in the process is described in the Horton Patents.

Figure 4:
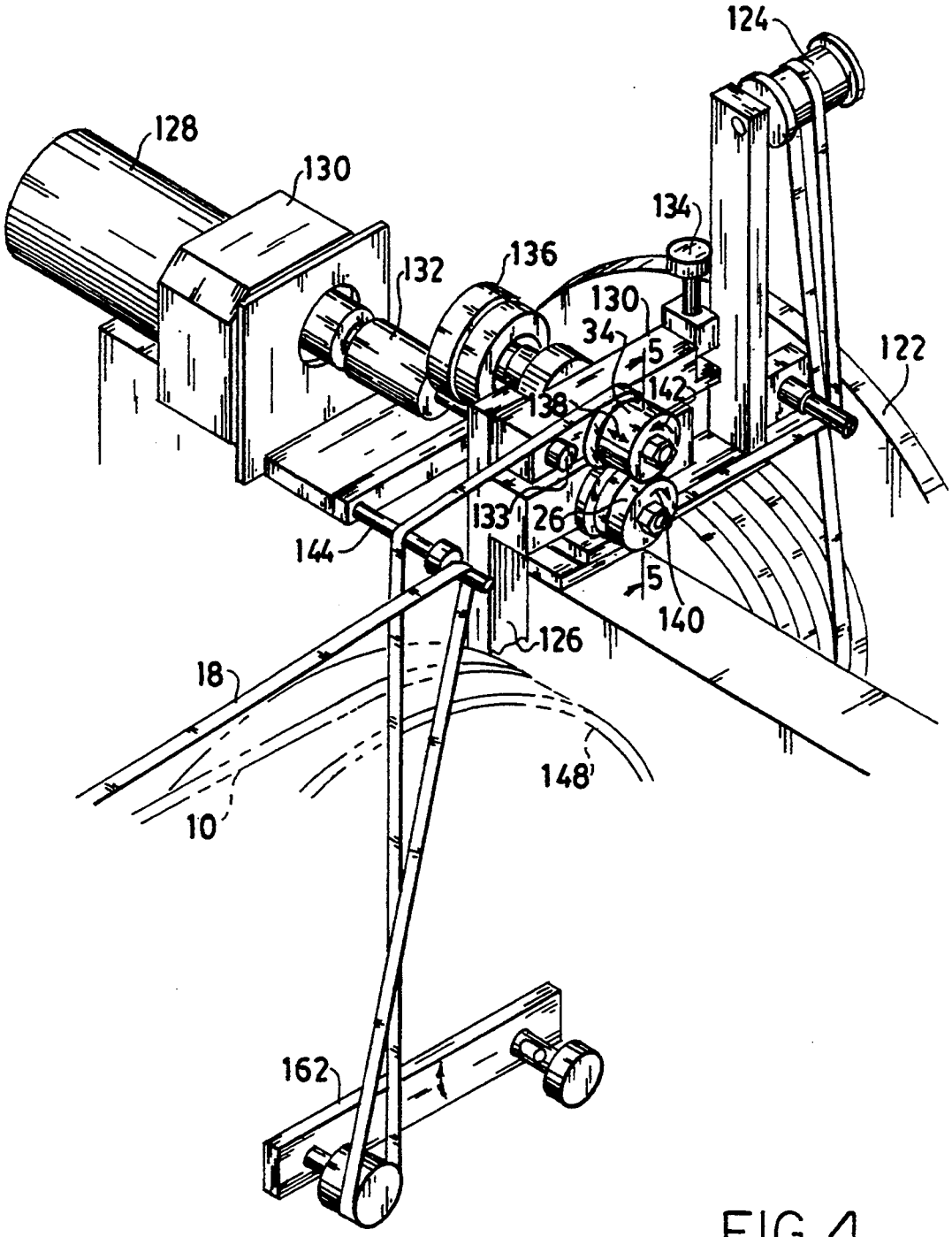
FIG. 4 is a perspective view illustrating an illustrative mechanism for coining the web which forms the fin.
Figure 7:
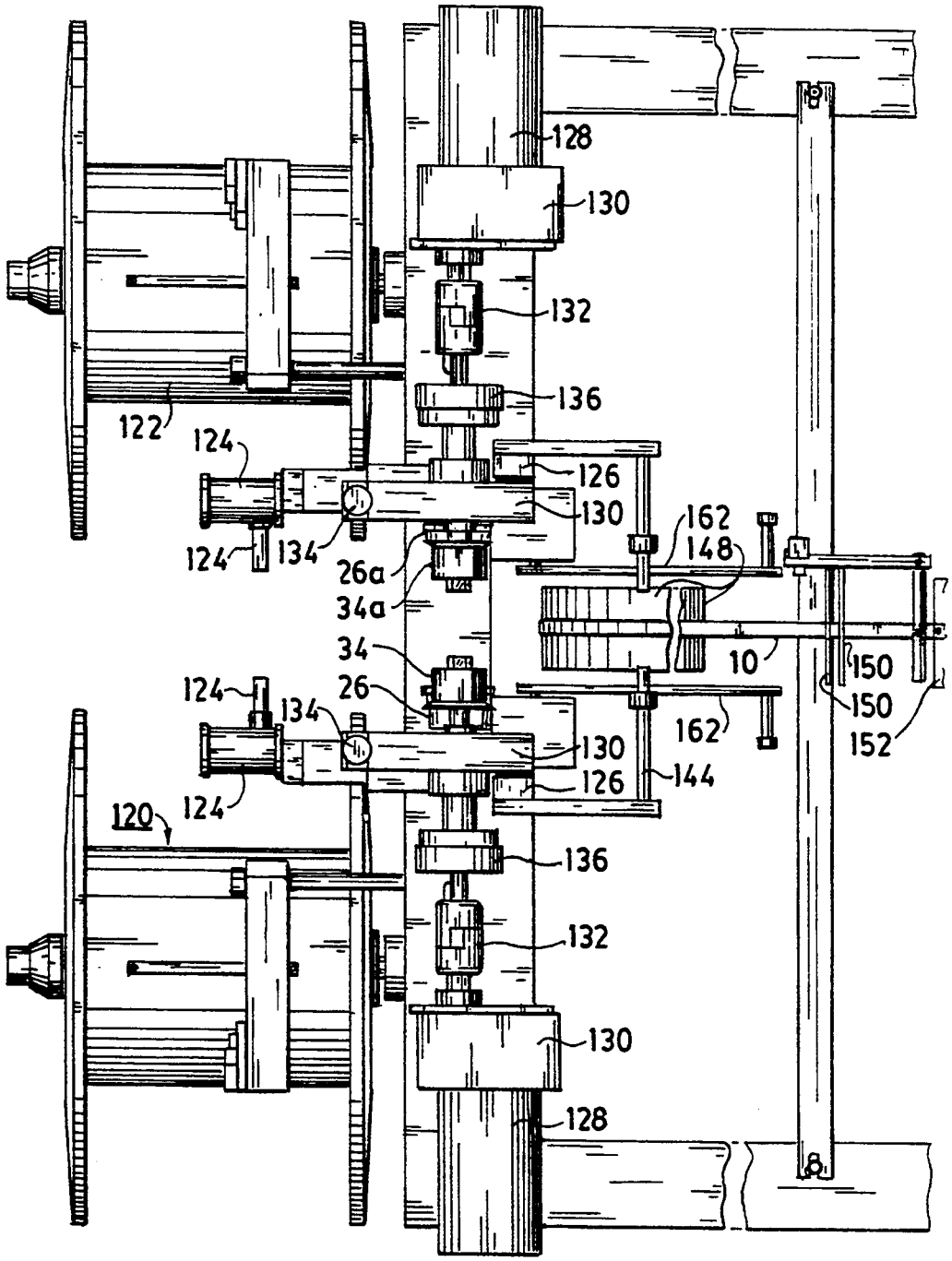
FIG. 7 is a plan view of the coining mechanisms for coining a pair of webs in the method of making pile weatherstripping, one of which mechanism is shown in FIG. 4.

The coining stations containing the coin and tapered guide wheels 26 and 34 and 26*a* and 34*a* are shown in FIG. 7. One of these stations, which contains the drive wheel 26 and the coiner wheel 34, is shown in perspective view in FIG. 4. Referring to FIG. 4, the web 18 is wrapped around the idler as it is unreeled from a reel 120 (see FIG. 7). Another wheel 122 is provided for the other web 18. Guides 124 change the path of the webs 18 and 20 and lead them into the driven tapered roller 26. This roller 26 is mounted in a block 126 and is driven by a variable speed motor 128, through suitable gearing in a gear box 130 and via couplers 132.

The coiner wheel 34 is mounted on a arm 130 which is pivotally mounted on a shaft 133 to the block 126. Pressure adjustment, adjusting the coining pressure applied to the web 18, is obtained by a threaded bolt 134 which may be journalled in the block 126 outboard of the pivot 133.

The location of the coin line may be adjusted by a micrometer mechanism 136 which moves the coiner wheel 34 laterally in the direction indicated by the arrows 138. The coiner wheel is mounted in bearings and is free to rotate and does so in the direction opposite to the direction in which the tapered wheel 26 is driven, as indicated by the arrows 140 and 142.

On leaving the coining station, the web 18 travels around guides 144 over an end guide pulley 148 around which the endless band 10 is entrained and then is guided via guides 150 onto the band. A station 152 at which the wrapping guides 46 and 48 (56) are located then engages the webs and wraps them around the band 10. If desired, there may be a plurality of such guides, for example, an additional pair of guides 46*a* and 48*a* which wrap another pair of webs 18*a* and 20*a* around the band 10 under the webs 18 and 20. These other webs 18*a* and 20*a* may also be coined by coining mechanisms upstream of the coining mechanisms illustrated in FIGS. 4 and 7.

In order to control the speed of the motors, pivotally mounted dancer arms 162 may be used around which the webs 18 and 20 are entrained. A potentiometer responds to the position of these arms and provides a control voltage which may be used to control the speed of each of the motors, so that the motors drive the webs at a speed commensurate with the speed of the endless band 10.

Figure 8:
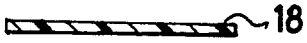
FIGS. 8–16 are a sequence of sectional views perpendicular to the band showing the weatherstrip in successive stages in the process of fabrication and the final product (FIG. 16)
Figure 9:
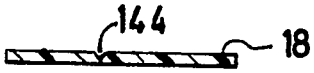
Figure 10:
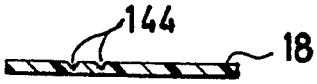
Figure 11:
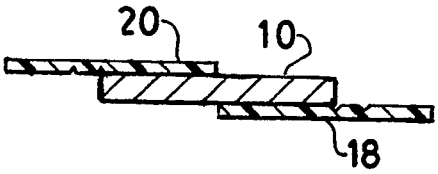
Figure 12:
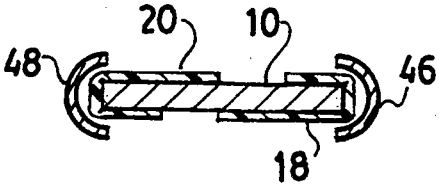

The method provided by the invention and the operation of the apparatus illustrated in the foregoing figures, are shown in various stages in FIGS. 8–16. Only one of the webs 18 is illustrated in FIGS. 8, 9, and 10. The other web is fabricated in the same way by first presizing, so that it has precise width between its longitudinal edges. The thickness of the web is desirably one-half the thickness of the band or less. The material used for the web may be any material which is conventionally used for fins in weatherstripping. Polypropylene made of fibers which are felted together is presently preferred. The web is then indented to provide the longitudinal lines of indentations. Either a single line of indentations 144 or double lines which fit around both of the edges of the band 10 may be used. The alignment mechanism is then applied as shown in FIG. 10 so as to place the webs 18 and 20 on opposite sides of the band 10. The webs are then wrapped as by means of the wrapping guides 46 and 48 (FIG. 12).

Figure 13:
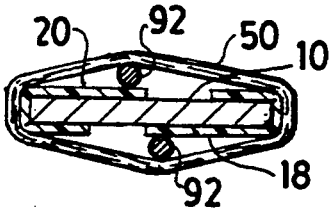
Figure 14:
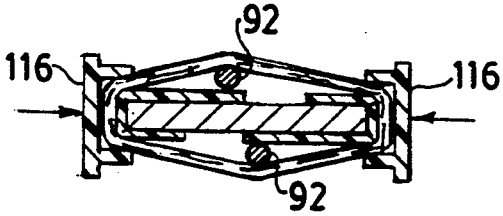
Figure 15:
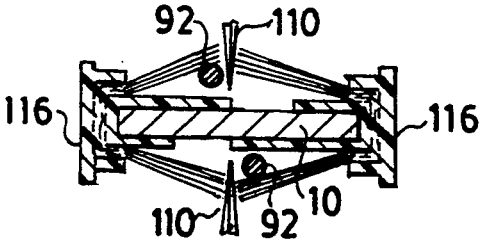
Figure 16:
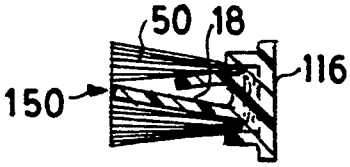

FIG. 13 shows the stage of the process where the yarn 50 is wound around the assembled band 10, webs 18 and 20 and guide wires 92. In the next stage 134, the backing strips 116 are applied and attached as by ultrasonic welding in the manner shown in the above-referenced Horton Patents. FIG. 15 shows the slitting operations with the slitter wheels 114. The yarn 50 is slit. It will be noted that the yarn starts puffing out as it is slit. The final product, namely one of the weatherstrips 150 is illustrated in FIG. 16.

From the foregoing description, there will be apparent then there has been provided an improved method of fabrication of pile weatherstrips having fins which enables precise precisioning of the fins with respect to the pile and provides economies in the use of thin material (the webs which form the fins) and speed of operation, principally because the reels containing the webs contain a large amount of web material so that the process need not be stopped and started to change reels of web material. Variations and modifications in the herein described method, within the scope of the invention, will undoubtedly suggest themselves to those skilled in the art. Accordingly, the foregoing description should be taken as illustrative and not in a limiting sense.

We claim:

1. A method of making pile weatherstripping having a backing strip and at least one fin between adjacent rows of pile on the backing strip of a desired height with respect to the pile which method comprises the steps of feeding a web having longitudinal edges onto a side of a traveling band which also has longitudinal edges; controllably aligning said web with one of said longitudinal edges of said web parallel to and at a first fixed and predetermined distance from one of said longitudinal edges of said band according to the desired height of said fin in said pile weatherstripping, and with the other of said longitudinal edges of said web overhanging said one of said longitudinal edges of said band by engaging said web and said band and indexing said web with respect of said band thereby establishing said height of said fin; wrapping said other of said longitudinal edges of said web around said one of said longitudinal edges of said band; winding yarn around said web and said band; attaching backing strips to said yarn and web where they wrap around said one of said longitudinal edges of said band and where said yarn wraps around the other of said longitudinal edges of said band; and slitting said yarn without cutting said web at a second fixed and predetermined distance from one of said longitudinal edges of said band, thereby providing a pair of weatherstrips with said yarn forming said rows of pile, at least one of said weatherstrips having a fin formed by said web, the height of said fin and the height of said pile being controlled in precise predetermined relationship.

2. The method of making pile weatherstripping according to claim 1 wherein the step of wrapping said web is carried out by the step of winding said yarn around said band.

3. The method of making pile weatherstripping according to claim 1 wherein said step of wrapping said web is carried out by guiding said web along and around said one longitudinal edge of said band.

4. The method of making pile weatherstripping according to claim 1, wherein said aligning step is carried out by guiding said web along a channel paralleling and spaced adjacent to said band on opposite sides thereof and along which said web passes, and said indexing step is carried out by indexing one of said longitudinal edges of said web against said channel.

5. The method of making pile weatherstripping according to claim 1, wherein said aligning step is carried out by forming at least one indentation in said web, extending longitudinally along said web in predetermined spaced relationship with said one of said longitudinal edges thereof, engaging said indentation and said longitudinal edge of said band with each other, and indexing said web with said indentation against said one longitudinal edge of said band.

6. The method according to claim 5 wherein said indentation is formed by coining said web.

7. The method according to claim 5 wherein said aligning step includes the step of forming a plurality of indentations each parallel to said one longitudinal edge of said web, and each spaced at a different distance from said one longitudinal edge of said web, and engaging and indexing said web at said one longitudinal edge of said band at one of said indentations.

8. The method according to claim 5 wherein said engaging step is carried out by wrapping said web around said one longitudinal edge of said band to form an interior corner at said indentation which engages said one longitudinal edge of said band at an exterior corner thereof, and said indexing step is carried out by indexing said interior corner against said exterior corner of said band.

9. The method according to claim 1 wherein a pair of webs are provided having longitudinal edges; said feeding step is carried out to feed said webs each onto an opposite side of said band; said aligning step is carried out by controllably aligning one of said longitudinal edges of different ones of said webs with different ones of the longitudinal edges of said band and at predetermined distances therefrom by engaging each of the webs and indexing them with respect to the band separately at different ones of said longitudinal edges, said indexing being provided by either an edge of said web against a channel or at least one longitudinal indentation in said web against an edge of said band; said wrapping step is carried out on each of said webs; said winding step is carried out by winding said yarn around said webs and said band; said attaching step is carried out to attach different ones of said backing strips to said yarn and different ones of said webs at different ones of said longitudinal edges of said band; and said slitting step is carried out by cutting the yarn without cutting either of said webs to provide thereby a pair of pile weatherstrips, each having a different one of said webs providing a fin of controlled predetermined height in precise predetermined relationship with the height of said rows of pile from the ones of said backing strips to which they are attached.

10. The method according to claim 9 wherein said aligning step is carried out by guiding said webs through separate channels adjacent to said opposite sides of said band and aligned therewith.

11. The method according to claim 9 wherein said aligning step is carried out by forming longitudinal indentations in said webs spaced from said one of said longitudinal edges thereof correspondingly with the desired height of said fins, and indexing said webs along said edges of said band at said indentations.

12. The method according to claim 11 wherein said indentations are made by coining said webs along parallel lines spaced from said one of said longitudinal edges thereof.

13. The method according to claim 1 wherein said slitting step is carried out by inserting a wire which extends along said band between said web and said yarn and between said one longitudinal edge of said web and said one longitudinal edge of said band, and lifting said wire to separate said yarn from said web thereby preventing cutting thereof while slitting of said web.

14. The method according to claim 9 wherein said slitting step is carried out by inserting wires along opposite sides of said band between said web and said yarn, and lifting said wires to separate said yarn from said web thereby preventing cutting thereof while slitting said yarn.

15. The method of making pile weatherstripping according to claim 1 further comprising the step of overlaying a plurality of said webs on said band, each of said webs having one of their longitudinal edges aligned in precise spaced relationship with said one longitudinal edge of said band, and the other of said edges of said webs overhanging said longitudinal edge of said band by engaging said webs individually and indexing the individual webs with respect to the band, and wrapping said overhanging edge around said one longitudinal edge of said band to provide a plurality of fins in said weatherstrip between the rows of pile thereof.

16. Apparatus for making pile weatherstripping having a backing strip and at least one fin between adjacent rows of pile on the backing strip of a desired height with respect to the pile using a traveling band, which apparatus comprises means for feeding a web having longitudinal edges onto a side of said traveling band which also has longitudinal edges; means for controllably aligning said web with one of said longitudinal edges of said web parallel to and at a first fixed and predetermined distance from one of said longitudinal edges of said band according to the desired height of said fin in said pile weatherstripping, said controllably aligning means comprising means for engaging said web and said band and indexing said web with respect of said band thereby establishing said height of said fin; means for wrapping the other of said longitudinal edges of said web around said one of said longitudinal edges of said band; means for winding yarn around said web and said band; means for attaching backing strips to said yarn and web where they wrap around said one of said longitudinal edges of said band and where said yarn wraps around the other of said longitudinal edges of said band; and means for slitting said yarn without cutting said web at a second fixed and predetermined distance from one of said longitudinal edges of said band, thereby providing a pair of weatherstrips with said yarn forming said rows of pile, at least one of said weatherstrip have a fin formed by said web, the height of said fin and the height of said pile being in precise, controllably predetermined relationship.

17. The apparatus for making pile weatherstripping according to claim 16, wherein said controllably aligning means is provided by means for forming at least one indentation in said web extending longitudinally along said web in predetermined spaced relationship with said one of said longitudinal edges thereof, and said engaging and indexing means is operative to engage said band and said one longitudinal edge of said web with each other for indexing said web on said one longitudinal edge of said band at said indentation in said web.

18. The apparatus according to claim 17 wherein said indentation forming means is provided by means for coining said web.

19. The apparatus according to claim 17 wherein said aligning means further comprising means for forming a plurality of indentations each parallel to said one longitudinal edge of said web and each spaced at a different distance from said one longitudinal edge of said web, and means for indexing said web at said one longitudinal edge of said band at one of said indentations.

20. The apparatus according to claim 17 wherein said indexing means is provided by means for wrapping said engaging and web around said one longitudinal edge of said band to form an interior corner which engages said one longitudinal edge of said band at an exterior corner thereof.

21. The apparatus of claim 16, wherein a pair of webs are provided having longitudinal edge; said feeding means comprises means for feeding said webs each onto an opposite side of said band; said controllably aligning means comprises means for aligning one of said longitudinal edges of different ones of said webs with different ones of the longitudinal edges of said band and at predetermined distances therefrom; said wrapping means wraps both of said pair of said webs; said engaging and indexing means being operative for engaging each of the webs and indexing them with respect to the band separately at different ones of said longitudinal edges, said indexing means comprising either an edge of said web against a channel or at least one longitudinal indentation in said web against an edge of said band; said winding means comprises means for winding said yarn around said webs and said band; said attaching means including means for attaching different ones of said backing strips to said yarn and different ones of said webs at different ones of said longitudinal edges of said band; and said slitting means includes means for cutting said yarn without cutting either of said webs to provide thereby a pair of pile weatherstrips, each having a different one of said webs providing a fin of predetermined height in precise controllably predetermined relationship with the height of said rows of said pile from the ones of said backing strips to which they are attached.

22. The apparatus according to claim 17 wherein said slitting means comprises means for inserting a wire which extends along said band between said web and said yarn and between said one longitudinal edge of said web and said one longitudinal edge of said band, and means for lifting said wire to separate said yarn from said web thereby preventing cutting thereof while slitting of said web.

23. The apparatus according to claim 21 wherein said slitting means comprises means for inserting wires along opposite sides of said band between said web and said yarn, and means for lifting said wires to separate said yarn from said web thereby preventing cutting thereof while slitting said yarn.

24. The apparatus according to claim 16 wherein said engaging means includes guides engageable with said band along the longitudinal edges thereof, and a web guide having a surface spaced from said band and disposed along one of the longitudinal edges of said web and in engagement therewith, and said surface indexing said web at said first fixed predetermined distance.

* * * * *